United States Patent [19]

Pronko et al.

[11] 4,147,210

[45] Apr. 3, 1979

[54] SCREEN HEAT EXCHANGER

[76] Inventors: Vladimir G. Pronko, Bolshoi Kozlovsky pereulok, 11, kv. 42; Evgeny V. Onosovsky, ulitsa Zoi i Alexandra Kosmodemianskikh, 8/7, kv. 131; Albert V. Chuvpilo, 3 Mytischinskaya ulitsa, 14a, kv. 86; Irina N. Zhuravleva, 4 Parkovaya ulitsa, 24, kv. 6; Viktor A. Korneev, Nagatinskaya ulitsa, 89, kv. 4; Dmitry A. Klimenkov, Chongarsky bulvar, 14, korpus 2, kv. 31; Galina M. Smirnova, ulitsa Vvedenskogo, 11, korpus 1, kv. 7; Vladimir V. Usanov, Novodevichy proezd, 2, kv. 5; Jury I. Ivanov, Obolensky pereulok, 9, korpus 3, kv. 15; Boris A. Chernyshev, Seleznevskaya ulitsa, 40, kv. 10; Vasily D. Nikitkin, Tsvetnoi bulvar, 25, kv. 95, all of Moscow; Anatoly F. Nikolaev, Shkolnaya ulitsa, 5, kv. 42, Leningrad; Maya S. Trizno, Kirovsky prospekt, 16, kv. 32, Leningrad; Valery G. Karkozov, Bolshaya Porokhovskaya ulitsa, 45, kv. 237, Leningrad; Tatyana J. Verkhoglyadova, prospekt Kosmonavtov, 92, kv. 137, Leningrad; Evgeny V. Moskalev, ulitsa Primakova, 16, kv. 15, Leningrad; Lidia I. Yakovleva, Vsevolzhsky raion, poselok Kuzmolova, Korotky pereulok, 8, Leningradskaya oblast, all of U.S.S.R.

[21] Appl. No.: 711,507

[22] Filed: Aug. 3, 1976

[51] Int. Cl.[2] ..... F28F 1/44

[52] U.S. Cl. ..... 165/165; 165/154; 165/179

[58] Field of Search ..... 165/154, 164, 165, 179, 165/173

[56] References Cited

U.S. PATENT DOCUMENTS

| | | | |
|---|---|---|---|
| 1,734,274 | 11/1929 | Schubart | 165/166 |
| 3,106,242 | 10/1963 | Jenssen et al. | 165/165 |
| 3,228,460 | 1/1966 | Garwin | 165/154 |
| 3,409,075 | 11/1968 | Long | 165/154 |
| 3,477,504 | 11/1969 | Colyer et al. | 165/164 |
| 3,491,184 | 1/1970 | Rietdijk | 165/165 |
| 3,543,844 | 12/1970 | Jordan et al. | 165/155 |
| 3,825,063 | 7/1974 | Cowans | 165/165 |
| 3,981,356 | 9/1976 | Granetzke | 165/179 |
| 3,983,932 | 10/1976 | Yamaguchi et al. | 165/154 |
| 4,016,928 | 4/1977 | Bartels et al. | 165/154 |

FOREIGN PATENT DOCUMENTS

| | | | |
|---|---|---|---|
| 995294 | 11/1951 | France | 165/179 |
| 1500641 | 11/1967 | France | 165/179 |

*Primary Examiner*—Sheldon J. Richter
*Attorney, Agent, or Firm*—Haseltine, Lake & Waters

[57] ABSTRACT

A screen heat exchanger intended to cool or heat various fluid media in different branches of industry.The exchanger comprises alternating screens and spacers rigidly connected into a bank; the spacers have holes for the passage of the fluid medium. The screens are made of a sheet material whose heat conduction is higher than that of the material of the spacers. The screen elements forming the meshes are inclined to the plane of the screen.

2 Claims, 21 Drawing Figures

SCREEN HEAT EXCHANGER

FIELD OF THE INVENTION

The present invention relates to heat exchangers and more particularly, to screen-type heat exchangers.

The screen heat exchanger according to the invention can be used successfully in cryogenic engineering, for example in air separating installations.

The present invention can be utilized in any branch of engineering which depends on the use of highly compact and efficient heat exchangers.

The use of the present invention will be most practicable in low-temperature refrigerating systems, for example in helium liquefiers and refrigerating gas-fired machines in the capacity of regenerators and regenerator-recuperators.

PRIOR ART

At present, low-temperature refrigerating systems utilize heat-exchangers with high technical and economic characteristics which can be attained if the heat exchangers have a highly-compact surface with good thermal and hydrodynamic properties and minimum values of such secondary effects as longitudinal heat conduction of the apparatus and nonuniformity of flow distribution over the passage area of the heat exchanger. The design and manufacturing technology of heat exchangers should guarantee the highest possible percentage of standardized units and parts and the fullest possible mechanization and automation of their manufacture.

These requirements are satisfied most completely by heat exchangers whose heat-exchanging surfaces are formed by screens assembled more or less tightly into a bank. Such surfaces can be made with the highest possible compactness known today, by the sufficiently convenient method and with the use of simple and cheap appliances.

The use in the heat exchangers of highly-compact surfaces which reduce considerably the overall dimensions of the heat exchanger, particularly its length, may impair its efficiency due to a considerable transfer of heat over the heat exchanger walls from the hot to the cold end of said exchanger.

A reduction of longitudinal heat conduction and the provision of anisotropic heat conduction, i.e., a maximum heat conduction in the direction of heat transfer between the currents of the fluid media and a low heat conduction along the flow of said media, is attained by the introduction of low-heat-conducting spacers sandwiched between the screens in a bank.

Known in the prior art is a screen heat exchanger manufactured by the Philips company in the capacity of recuperative heat exchangers of helium liquefiers and refrigerators. This heat exchanger is made up of perforated spacers and screens interconnected rigidly into banks.

The spacers of this heat exchanger are made of glue-impregnated paper and have square holes. The screens are woven of wire with square meshes. The screens and spacers are assembled in a bank in an alternating sequence so that the corresponding holes in all the spacers coincide, thus forming passages for the flow of helium.

The two counteropposed edges of each hole are parallel to the screen warp while the other two are parallel to the screen weft.

The assembled bank is clamped and heated, the glue softens and penetrates into the meshes between the screen wires, thus interconnecting the spacers with each other and the screen wires after which the bank is polymerized and solidified. In such a baked bank the holes in the spacers form square passages for the flow of helium and the bridges between the spacer holes form pressure-tight walls of the passages.

The passages for the forward and reverse flows of helium are arranged in a staggered order in the exchanger cross section so that each forward-flow passage is surrounded by four reverse flow passages on four sides and each reverse-flow passage is surrounded by four forward-flow passages.

The heat exchanger comprises at least a pair of headers communicating with the bank passages. The headers are rigidly connected with the opposite sides of the bank and distribute the forward and reverse flows of helium among the passages of the bank.

Such a heat exchanger is noted for a very valuable property, i.e., anisotropic heat conduction of its structure. A high lateral heat conduction needed for efficient heat transfer is ensured by the use of copper wire screens while a low longitudinal heat conduction reducing considerably the heat transfer along the heat exchanger walls is obtained by the provision of paper spacers sandwiched between the screens.

The square cross section of the passages is most practicable for the woven wire screens since it ensures uniform heat transfer along the cross section of such a heat exchanger because all the wires of the screen serve as ribs of the heat-exchanging surface and take a uniform part in the process of heat transfer.

The woven wire screens can be set either at a certain distance from one another in a bank, or fit tightly against one another (see U.S. Pat. No. 1,500,641, Cl.F28d, 1967, France).

A disadvantage of such a heat exchanger lies in its structural features caused by the use of woven wire screens.

The screens of this heat exchanger are characterized by an insufficiently intensive heat transfer at a comparatively high hydrodynamic resistance. This should be attributed to an unfavourable profile from the hydrodynamic point of view, said profile being constituted by a system of curved and intertwined cylinders with the fluid flow moving laterally around them.

In order to improve compactness of the heat-exchanging surface in such a heat exchanger it is possible to reduce the diameter of the wires and their spacing in the screen. However, the reduction in diameter is limited by a decreased strength of the wies which hampers the manufacture of woven screens. The requirement of a certain strength of the wire used for making woven screens places also certain restrictions on the selection of the screen material. For example, it is practicable that recuperative heat exchangers of helium liquefiers and refrigerators should comprise screens made of electrolytic copper whose heat conduction grows considerably with the drop of temperature. However, thin wires made of this grade of copper are not strong enough for making woven screens.

Additionally, in such a screen heat exchanger with square passages whose cross section is governed by the use of woven wire screens, the relation between the cross sections of the forward and reverse flows is equal to unity which increases the weight and size of the heat exchanger since the pressure of the forward flow of helium is a few times higher than that of the reverse flow.

The design of the header for the staggered square passages of the forward and reverse flows is relatively complicated and difficult from the manufacturing point of view.

Also known in the art is a screen heat exchanger manufactured by General Electric Co; this exchanger also comprises alternating spacers and screens rigidly interconnected into a bank. The spacers have holes and are made of a low-great-conducting material. The screens are made of a sheet material characterized by a high heat conduction. Each screen is provided with meshes formed by the screen elements, i.e., by the bridges arranged in the plane of the screen (or perforated plate). The screens and spacers are assembled into a bank in an alternating order so that the corresponding holes in all the spacers coincide, forming passages for the fluid media. The heat exchanger comprises headers connected rigidly to the bank and distributing the fluid media among the passages of the heat exchanger (see U.S. Pat. No. 2,008,976, Cl. F28d, 9/00, 1970, Federal Republic of Germany).

This heat exchanger is devoid of some of the disadvantages inherent in the Philips heat exchanger since it has plate-type screens instead of the woven wire screens.

In this case the selection of the screen material and the size of the elements forming the screen meshes is not limited by the strength considerations.

Additionally, the screen of a sheet material ensures uniform heat transfer along the cross section of the heat exchanger with slotted passages wherein the relationship between the forward and reverse flows of the fluid medium can vary within wide limits depending on pressure and rates of flow.

The headers of such a heat exchanger with slotted passages are comparatively simple in design and cheap to manufacture.

However, the use of screens made of a sheet material instead of woven wire limits the increase in compactness of the heat-exchanging surface because the screens in the heat exchanger being considered can be set only at a certain distance from one another, said distance being equal to the thickness of the spacer.

Furthermore, the profile of the screen mesh elements in such a heat exchanger is disadvantageous from the hydrodynamic point of view, said profile consisting of a system of parallel plates around which are fluid medium flows. This results in a high hydrodynamic resistance at an insufficiently high intensity of heat transfer in the exchanger under consideration.

SUMMARY OF THE INVENTION

An object of the invention lies in providing a screen heat exchanger whose screens ensure a highly intensive heat transfer at a comparatively low hydrodynamic resistance of the heat exchanger and a high compactness of the heat-exchanging surface.

This object is accomplished by providing a heat exchanger comprising spacers with holes which form passages for the fluid medium, screens made of a sheet material whose heat conduction is considerably higher than that of the spacers, said spacers and screens alternating with each other and being rigidly connected into a bank, the screen elements forming meshes, and at least two headers communicating with the passages of the bank and connected rigidly to its counteropposed sides for distributing the fluid medium among the bank passages wherein, according to the invention, said mesh-forming elements are set an angle to the plane of the screen.

It is practicable for the angle of the mesh-forming elements to the screen plane to be from 45 to 90°.

Such a design of the screen heat exchanger will ensure a more favorable profile of the screen elements from the hydrodynamic point of view, said profile being constituted by a system of short parallel plates washed longitudinally or at a small angle by the flow of fluid medium. This brings about a more favorable relationship between the intensity of heat transfer and the hydrodynamic resistance.

Such screens made of a sheet material guarantee a high compactness of the heat-exchanging surface since in this case the increase in compactness is not limited by the strength of the source material. Additionally, owing to the inclination of the mesh-forming elements, the screens in the bank can fit tightly against one another or even enter one another partly, which likewise adds to greater compactness of the heat-exchanging surface.

It is practicable that the portions of each screen located between the passages and along its periphery should be made of solid sheet material.

The provision of such screen portions increases the intensity of heat transfer due to a reduction in the thermal resistance of the heat exchanger walls.

It is recommended that said portions of each screen located between its passages and along the periphery should be provided with projections for fixing the screen in the bank.

This ensures simple and reliable fixing of the screens in the bank thus reducing the danger of such a secondary effect as nonuniform distribution of fluid media among the passages of the heat exchanger.

Thus, the screen heat exchanger according to the present invention is characterized by a high intensity of heat transfer at a comparatively low hydrodynamic resistance and a high compactness of the heat-exchanging surface.

The suggested layout of the heat exchanger according to the invention allows it to be made of highly-productive automatic devices which cuts down considerably the amount of labor spent during its manufacture.

The screens of such a heat exchanger used in the capacity of recuperative heat exchangers can be made of various materials, e.g. electrolytic sheet copper or pure aluminium whose heat conduction grows with the drop of temperature.

In the regenerators of gas-fired refrigerating machines the screens can be made of sheet lead which retains a considerably high heat capacity at cryogenic temperatures.

BRIEF DESCRIPTION OF THE DRAWINGS

These and other features and advantages of the invention will become more apparent from the detailed description of an example of its realization with reference to the accompanying drawings in which.

DETAILED DESCRIPTION

Figure 1:
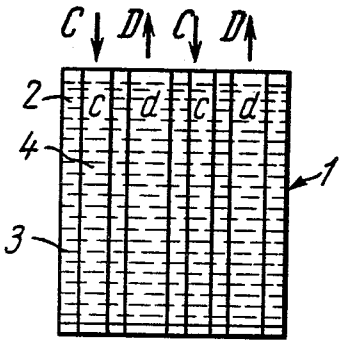
FIG. 1 is a schematic longitudinal section through the screen heat exchanger with slotted passages according to the invention, the headers being omitted for convenience.
Figure 2:
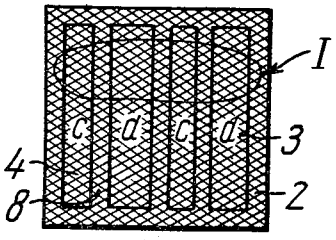
FIG. 2 shows the heat exchanger in plan view.

The screen heat exchanger according to the invention comprises alternating spacers 2 (FIG. 1) and screens 3 rigidly interconnected into a bank 1. The spacers 2 have holes which form passages 4 in the bank 1 for the flow of the fluid medium. The passages 4 may vary in cross section and be, for example, of a slotted shape (FIGS. 1 and 2). Such passages may have different widths of the slot for the passage of the forward flow moving in the direction of arrow C and the reverse flow moving along arrow D, the fluid in this case being helium. The slotted cross section of the passages makes it possible to change within wide limits (from 1 to 5 and over) the relationship between the cross sections of the forward and reverse flow passages 4 depending on their pressure and flow rates. In its turn, this gives a possibility of producing a screen heat exchanger for the given operating conditions with the optimum weight, size and hydrodynamic resistance.

Figure 3:
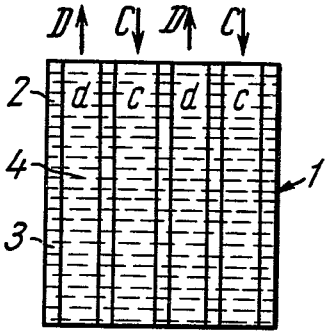
FIG. 3 is a schematic longitudinal section through the screen heat exchanger with square passages according to the invention, the headers being omitted for convenience.
Figure 4:
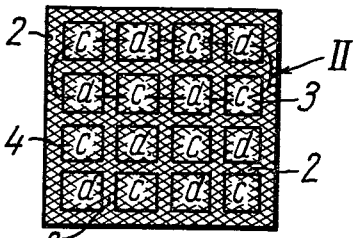
FIG. 4—shows the heat exchanger in FIG. 3 in plan view

The passages may also be of a square cross section as shown in FIGS. 3 and 4. In this case the relationship between the cross sections of the passages for the forward flow moving along arrow C and those of the reverse flow moving along arrow D is equal to unity. These passages are practicable when the volumetric flow rates of the forward and reverse flows are nearly the same.

Figure 5:
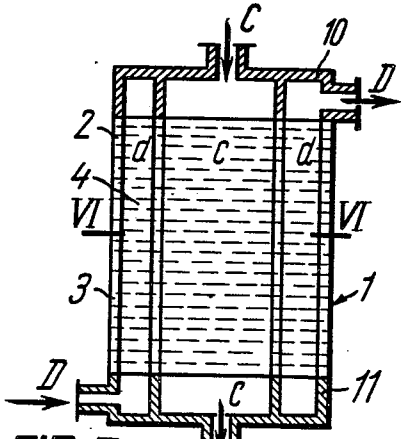
FIG. 5 is a schematic longitudinal section through the screen heat exchanger with circular and round passages according to the invention.
Figure 6:
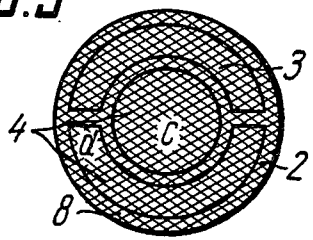
FIG. 6—is a sectional view taken on line VI—VI in FIG. 5.
Figure 7:
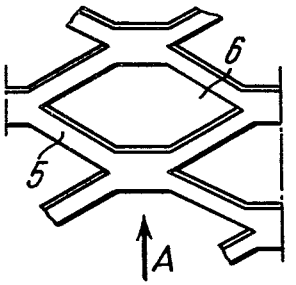
FIG. 7 is a plan view of a hexahedral screen mesh, on enlarged scale.
Figure 8:
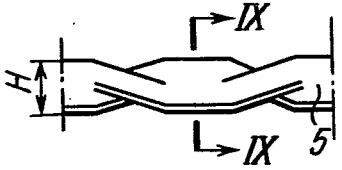
FIG. 8 is a view along arrow A in FIG. 7.

In some cases the passages may be of a circular or round cross section as shown in FIGS. 5 and 6.

The spacers 2 for the screen heat exchangers used in cryogenic engineering are made in this particular embodiment of the invention from thermoreactive epoxy-novolak compound film characterized by good adhesion to the majority of metals. This film is made by extrusion at a high speed, approaching 60 m/hr. The material of the spacers is cheap and displays high strength at cryogenic temperatures.

In other cases of employment of the heat exchangers according to the invention the material of the spacers 2 as well as that of the screens 3 is selected to suit the operating conditions of the exchanger. For example, when the heat exchanger operates under the conditions when the influence of the longitudinal heat conduction is not essential, the spacers may be made from sheet flux or from a material with an applied flux.

The screens 3 are made from a sheet material whose heat conduction is considerably higher than that of the material of the spacers 2 which ensures anisotropic heat conduction of the screen heat exchanger and particularly a maximum possible lateral heat conduction which intensifies heat transfer and a low longitudinal heat conduction which reduces the transfer of heat from the hot to the cold end of the heat exchanger along its walls.

Figure 9:
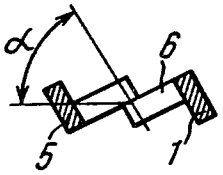
FIG. 9 is a section taken along line IX—IX in FIG. 8.
Figure 10:
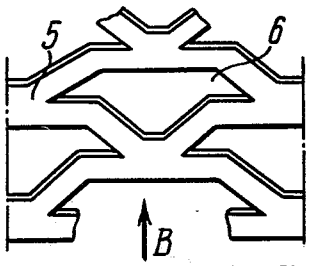
FIG. 10 is a plan view of an octahedral screen mesh, on enlarged scale.
Figure 11:
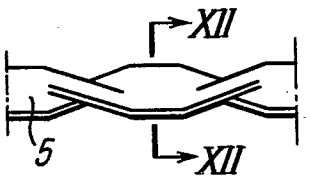
FIG. 11 is a view along arrow B in FIG. 10.
Figure 12:
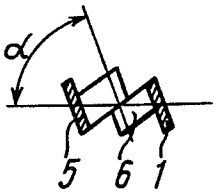
FIG. 12 is a section taken along line XII—XII in FIG. 11.

Each screen 3 is made so that its elements 5 (FIGS. 7, 8, 10, 11) forming the meshes 6 are inclined at an angle $\alpha$ (FIGS. 9 and 12) to the plane of the screen 3.

It is practicable that the angle $\alpha$ should be from 45 to 90°. Inclination of the elements 5 of the meshes 6 is produced when the screen is made from a sheet material on an automatic device and is determined, on the one hand, by the plasticity of the material and, on the other, by the optimum relationship for each particular application of the apparatus between its thermal and hydrodynamic properties.

The meshes 6 may have various polygonal shapes, mostly extending in one direction and depending on the shape of the cutting tool of the automatic device.

The source material for making the screens in this version of the invention is constituted by a coiled sheet 0.05–0.5 mm thick of various metals loaded into the automatic device. Such a screen whose compactness is 2000–20000 $m^2$ of the surface per cubic meter of free volume is characterized by a sufficiently high accuracy of the basic dimensions, reaching 3–5%.

The screen can be made of any sheet material whose elongation is not under 15%.

With respect to cryogenic engineering, the most promising tendency is the employment of electrolytic sheet copper for the recuperative heat exchangers of helium liquefiers and refrigerators and of sheet lead for the regenerators of gas-fired refrigerating machines.

Figure 14:
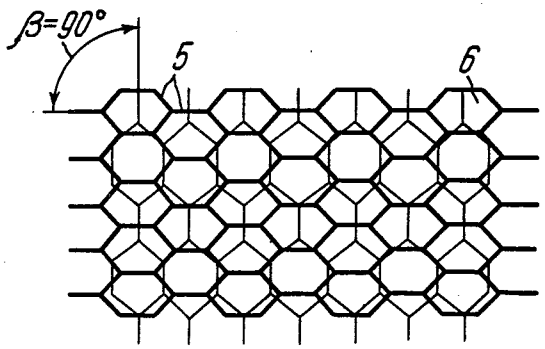
FIG. 14 is fragment II in FIG. 4, enlarged, the spacers being omitted for convenience.
Figure 13:
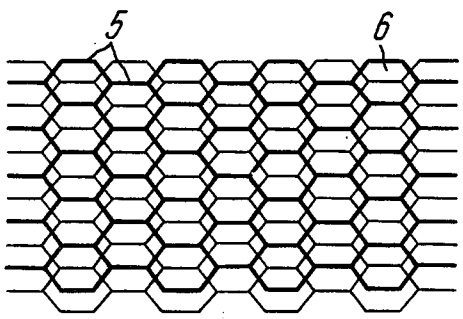
FIG. 13 is a fragment I in FIG. 2 enlarged, the spacers being omitted for convenience.

The relative location of meshes in the bank 1 may vary as shown in FIGS. 13 and 14 depends on the shape of the passages 4. For instance, the best relative arrangement of the meshes for the slotted passages 4 (FIGS. 12) is shown in FIG. 13 in which case the total length of the mesh elements in the cross section of the passage is minimum and, as a consequence, the heat transfer and the strength of the side walls of the passages are greatest.

The most practicable relative arrangement of the screens 3 for the square passages 4 (FIGS. 3, 4) is shown in FIG. 14. This arrangement of the screens ensures uniform heat transfer and strength of all the four walls of the square passage 4.

In the passages 4 of a circular and round cross section shown in FIG. 6 the screens 3 can be arranged in any arbitrary way relative to one another.

Figure 20:
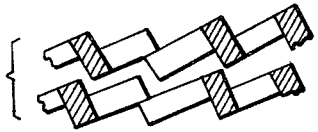
FIG. 20 is a schematic sectional view similar to FIG. 19 showing the inclined screen elements of the juxtaposed screens.
Figure 21:
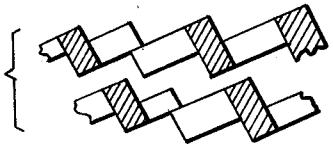
FIG. 21 shows a modification of the assembly in FIG. 20.

Furthermore, the screens 3 can be arranged differently in the height of the bank; they may be either at a certain distance from one another as shown in FIG. 21, or fit tightly against each other or else enter partly into one another as shown in FIG. 20.

The screens may differ in construction.

Figure 15:
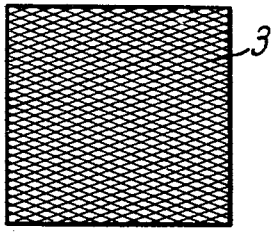
FIG. 15 is a schematic plan view of the screen.
Figure 18:
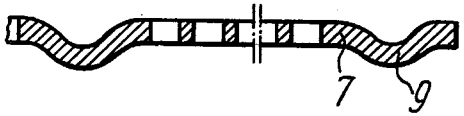
FIG. 18 is a section taken along line XVIII—XVIII in FIG. 17, on enlarged scale, the inclination of the elements being not shown for convenience.

The one-piece screen 3 shown in FIG. 15 is easiest to manufacture. However, the passages 4 in the heat exchanger with such screens may differ somewhat in cross section which leads to irregular distribution of the fluid flow among the passages 4 and, in some cases, to a reduction in the thermal characteristics of the heat exchanger. This is explained by the fact that the spacers 2 have a certain tolerance in thickness so that the surplus material of the spacers 2 is squeezed into the passages 4 when the heat exchanger is baked.

The screen 3 with the portions 7 (FIG. 16) of solid sheet material located between the passages 4 and along the periphery ensures identical cross sections of the passages 4. The bridges 8 (FIG. 2) of the spacer 2 in this case are narrower than the solid portions 7 of the screen 3 by the value which depends on the tolerance on the width of the spacer 2. The surplus material of the spacer 2 squeezed out during baking is always located between the solid portions 7 of the adjacent screens 3 and does not distort the cross section of the passages 4.

Figure 16:
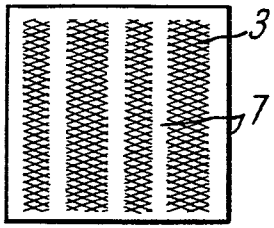
FIG. 16 is a schematic plan view of the screen with portions of solid sheet material between the passages and along the periphery.

During the manufacture of the heat exchanger, the screens 3 in the banks shown in FIGS. 15 and 16 are fixed by external retainers (not shown in the drawing).

Figure 19:
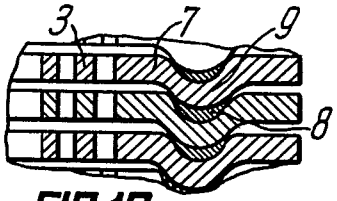
FIG. 19 is a schematic view of the jointing of screens with projections for fixing the spacers in the bank of the screen heat exchanger, enlarged, the inclination of the screen elements not being shown for convenience.

The screen 3 may have fixing projections 9 (FIG. 17) on the solid portions 7 between the passages 4 and along its periphery which makes it possible to fix the screens 3 during manufacture accurately in relation to one another both in cross section and along the height of the bank 1 as shown in FIG. 19.

Figure 17:
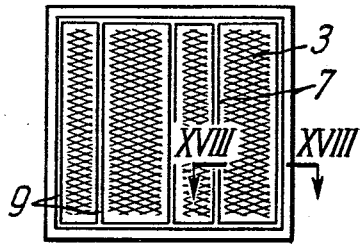
FIG. 17 is a schematic plan view of the screen with projections located on the portions of solid sheet material between the passages and along the periphery of the screen, enlarged.

Additionally, the use of the screens shown in FIGS. 16 and 17 in the screen heat exchanger according to the invention gives a reduction in the thermal resistance of its walls and intensifies heat transfer in the apparatus.

The headers 10 and 11 (FIG. 5) intended to distribute the forward and reverse flows of helium among the passages 4 of the screen heat exchanger are rigidly connected to the bank 1.

The parts and units of the screen heat exchanger, i.e., spacers 2 and screens 3 and the headers 10, 11 are flat and can easily be standardized.

Thus, due to the solution suggested in the present invention it is possible to provide an efficient and highly-compact screen heat exchanger with anisotropic heat conduction of its structure, consisting of standardized units and parts whose manufacture can easily be mechanized and automated.

The screen heat exchanger according to the present invention used as a recuperative heat exchanger in cryogenic helium installations operates as follows.

The fluid medium, in this case warm gaseous helium of a forward flow whose direction is shown by arrows C moves from the compressor (not shown in the drawing) into the header 10 wherein it is distributed uniformly among the passages 4 of the bank 1 marked with letter C in FIGS. 1 through 6. Moving through these passages, helium flows around the screens 3 and transfers heat to them. Then the heat received by the screens 3 is transferred due to their heat conduction into the passages marked d.

Then the helium cooled in the passages 4 "C" enters the header 11 wherefrom part of the helium flows into a gas expansion machine (not shown) expands thereat and is additionally cooled. The other part of the forward flow of helium is throttled in valves (not shown) and returns into the header 11 in the form of a cold reverse flow combined with the flow of helium leaving the gas expansion machine; in the header 11 this helium is distributed among the passages 4 marked with letter d. The reverse flow of helium moves through these passages in the direction shown by arrow D and, flowing around the screens 3, is heated, accumulates in the header 10 and leaves the heat exchanger.

An experimental specimen of the screen heat exchanger has undergone laboratory tests which have shown that the screen heat exchanger according to the invention is characterized by a good relationship between heat transfer and hydrodynamic resistance along with comparatively small size and weight. Compactness of the heat-exchanging surface formed by the screens of various dimensions ranges from 2,000 to 20,000 $m^2$ of surface per cubic meter of free volume.

The screen heat exchanger according to the present invention is technologically processable, its parts can be highly standardized and the basic processes of its manufacture yield themselves readily to mechanization and automation.

What is claimed is:

1. A screen heat exchanger having anisotropic heat conductivity comprising: a plurality of spacers having holes defining passages for fluids for heat exchange therebetween; screens made of a sheet material having a heat conductivity higher than that of said spacers, said spacers and said screens being arranged alternately and being rigidly connected into a bank; said screens including a plurality of elements forming a plurality of meshes on said screens, said elements being disposed within the space of each passage in the direction of heat transfer from one fluid to another fluid and inclined with respect to the place of said screens at an angle substantially in the range between 45° and 90°, said elements of adjacent screens extending within one another without making contact; and at least two headers communicating with the passages of said bank and secured to the opposed ends of the bank for distributing the fluids along the passages of said bank.

2. An exchanger as claimed in claim 1 wherein said screens and spacers have solid portions which are aligned with one another.

* * * * *